US010610019B2

(12) United States Patent
Bock

(10) Patent No.: US 10,610,019 B2
(45) Date of Patent: Apr. 7, 2020

(54) SYNCHRONIZED MECHANISM FOR AN OFFICE CHAIR

(71) Applicant: BOCK 1 GMBH & CO. KG, Postbauer-Heng (DE)

(72) Inventor: Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 67 days.

(21) Appl. No.: 15/949,109

(22) Filed: Apr. 10, 2018

(65) Prior Publication Data

US 2018/0289159 A1 Oct. 11, 2018

(30) Foreign Application Priority Data

Apr. 10, 2017 (DE) ..... 10 2017 107 636

(51) Int. Cl.
*A47C 1/032* (2006.01)

(52) U.S. Cl.
CPC ..... *A47C 1/03205* (2013.01); *A47C 1/03255* (2013.01); *A47C 1/03294* (2013.01)

(58) Field of Classification Search
CPC ..... A47C 1/03255; A47C 1/03294
See application file for complete search history.

(56) References Cited

U.S. PATENT DOCUMENTS 7,614,697 B1 * 11/2009 Lai ..... A47C 1/03255 297/301.1
2009/0146476 A1 * 6/2009 Kan ..... A47C 1/03255 297/284.4
2015/0296988 A1 * 10/2015 Machael ..... A47C 3/20 297/338

FOREIGN PATENT DOCUMENTS

| | | | | |
|---|---|---|---|---|
| CA | 2808205 | A1 * | 3/2012 | ..... A47C 1/03294 |
| DE | 202011108433 | U1 | 3/2012 | |
| EP | 1258208 | A2 * | 11/2002 | ..... A47C 1/03255 |
| EP | 2772156 | A1 * | 9/2014 | ..... A47C 1/03255 |
| EP | 3120732 | A1 * | 1/2017 | ..... A47C 1/03294 |
| GB | 2536290 | A | 9/2016 | |
| JP | 3177652 | U * | 8/2012 | ..... A47C 1/03261 |
| WO | WO-2011148414 | A1 * | 12/2011 | ..... A47C 1/03255 |

* cited by examiner

*Primary Examiner* — Timothy J Brindley
(74) *Attorney, Agent, or Firm* — Laurence A. Greenberg; Werner H. Stemer; Ralph E. Locher

(57) ABSTRACT

A mechanism is provided for an office chair. In order to accomplish an advantageous motion characteristic of the mechanism and thus of the office chair, a synchronized mechanism provides a correlated seat/backrest movement of an office chair. The backrest support is connected to the seat support not directly and immediately, but via a coupling element. The force applied to the seat support upon swiveling the backrest support is applied to the seat support solely via the coupling element. Two guide element pairs are provided to guide the seat support relative to the base support.

8 Claims, 4 Drawing Sheets

SYNCHRONIZED MECHANISM FOR AN OFFICE CHAIR

CROSS-REFERENCE TO RELATED APPLICATION

This application claims the priority, under 35 U.S.C. § 119, of German application DE 10 2017 107 636.0, filed Apr. 10, 2017; the prior application is herewith incorporated by reference in its entirety.

BACKGROUND OF THE INVENTION

Field of the Invention

The invention relates to a mechanism for an office chair, with a base support mountable on a chair column, with a seat support arranged on the base support and movable relative to the base support, and with a backrest coupled to the seat support. A swiveling of the backrest produces a movement of the seat support relative to the base support.

With such a mechanism, such as is used as a subassembly in the seat structure of an office chair, a kinematic configuration is provided which provides a particular relative movement of seat and backrest to each other, so that a correlated seat/backrest movement results ("synchronized mechanism").

The seat of the office chair generally provided with a cushioned seat surface is mounted on the seat support. The backrest support, which extends backward from the synchronized mechanism proper in the usual way, carries on an upwardly extending boom the backrest of the office chair. Seat support and backrest support are usually articulated such that a backward swivel movement of the backrest, such as can be produced by the seat occupant leaning back against the backrest, induces a downward movement of the rear edge of the seat.

SUMMARY OF THE INVENTION

One problem which the present invention proposes to solve is to accomplish a more advantageous motion characteristic of the mechanism and thus of the office chair.

This problem is solved by a mechanism as claimed in the main independent claim. Accordingly, the synchronized mechanism according to the invention for a correlated seat/backrest movement of an office chair contains a base support mountable on a chair column, a seat support arranged on the base support and movable relative to the base support, and a backrest support connected to the seat support. A swiveling of the backrest support produces a movement of the seat support relative to the base support. The backrest support able to swivel about a transverse axis is articulated in particular by the transverse axis directly to the base support and thus swiveled on the base support. The backrest support is connected to the seat support not directly and immediately, but via a coupling element, preferably provided in the area of the front end of the backrest support. The coupling element is articulated both to the backrest support and to the seat support, especially forming each time a swivel joint, wherein the force applied to the seat support upon swiveling the backrest support is applied to the seat support solely via the coupling element.

A first guide element is provided on the base support and a second guide element is provided on the seat support, wherein the first guide element and the second guide element cooperate to form a guide element pair such that a swiveling of the backrest support produces a movement of the second guide element moving together with the seat support along the first guide element which is stationary together with the base support, and thus a movement of the seat support relative to the base support.

Such a construction of the mechanism makes it possible to vary the correlated movement of seat and backrest with respect to each other with especially simple structural means. The synchronized travel of seat and backrest can be altered, for example, by a simple change to the travel of the second guide element. In one embodiment of the invention, only the position angle of a guide slot in the seat support need be changed in order to obtain a different motion characteristic.

Two guide element pairs are provided, spaced apart from each other in the chair lengthwise direction, namely a front guide element pair looking in the chair lengthwise direction, and a rear guide element pair looking in the chair lengthwise direction. By this means, an especially secure movement of the seat support relative to the base support is achieved. The base support is connected to a front area of the seat support, preferably by the front guide element pair, and the base support is connected to the rear area of the seat support preferably by the rear guide element pair.

This makes possible a motion curve of the front area of the seat support and a motion curve of the rear area of the seat support which are separate from each other. By a guide element pair is meant here the respective cooperating pairing of sliding element and slide track or rolling element and roll track.

The invention accomplishes a more advantageous motion characteristic of the mechanism and thus of the office chair. The coupling element on the one hand provides an additional degree of freedom for the coupling of the backrest support to the seat support, which is in fact needed to enable a relative movement of backrest support and seat support to each other. Without the coupling element, the desired relative movement of seat support and backrest support would not be possible, since the two components would block each other, due to their respective dictated movement paths relative to the base support. On the other hand, the coupling element can provide a special, advantageously synchronized movement process of backrest support and seat support, resulting in a desirable variable transmission ratio, as further explained below.

Advantageous embodiments of the invention are indicated in the dependent claims.

Preferably, the connection point of the coupling element to the seat support serving as the location of force application to the seat support upon swiveling of the backrest support, being configured in particular as a swivel joint, is not identical to the connection point of the seat support to the base support serving as the location for guiding the seat support on the base support, which is formed here by the second guide element. In other words, the two locations are different, i.e., the location of force application from the backrest support to the seat support is situated remote from or spaced apart from the location for guiding the seat support on the base support. Due to the fact that the location of force application to the seat support and the guide location of the seat support on the base support are different, the desired synchronized movement can be achieved in this mechanism. Whereby the swiveling of the backrest support induces a movement process of the seat support such that, with the aid of the coupling element, a non-constant and thus steadily varying transmission ratio of the two components, backrest support and seat support, results during the swiveling. This is critical to the self-adjusting effect of the chair mechanism and advantageous to the kinematics experienced by the occupant of the chair.

It is especially advantageous when the first guide element contains a sliding or rolling element and the second guide element comprises a slide or roll track along which the sliding or rolling element moves. Depending on the design, the sliding or rolling element may be rigid or rotatable about a rotation axis situated transversely to the chair lengthwise direction. The slide or roll track may have any desired track curve, the choice of which can alter the motion characteristic of the mechanism. In the sense of a kinematic reversal it is also conceivable that the second guide element contains a sliding or rolling element and the first guide element contains a slide or roll track along which the sliding or rolling element moves.

In a simple and therefore especially robust and uncomplicated embodiment of the invention, the slide or roll track is formed by a guide slot contained in one structural element of the mechanism. Preferably, the guide slot is located in the seat support, or for a kinematic reversal it is located in the base support. The guide slot preferably has oppositely situated slide or roll surfaces, so that the sliding or rolling element is guided in the slot resting at the same time against two bearing surfaces when performing a relative movement of seat support and base support to each other.

Even though the guide elements joining the seat support to the base support form a linear guide, thanks to the use of the coupling element there is achieved not a linear, but a desirable nonlinear synchronized movement of the seat with the backrest. However, other guide tracks are also possible, besides guides with straight guide tracks. The synchronized movement of the seat support can be individually adapted in the most simple manner by the configuration of the guides, especially their position, such as the choice of a suitable tilt angle of the guide relative to the vertical.

In order to provide an especially advantageous motion characteristic and to achieve a great variability of the synchronized mechanism in regard to different movement paths, it is provided in one especially preferred embodiment of the invention that the location of force application, looking in the chair lengthwise direction, is always, i.e., in all swivel positions of the backrest support, situated behind the front guide element pair. Furthermore, it has proven to be especially advantageous for the location of force application to be located always between the front guide element pair and the rear guide element pair.

The coupling element is especially important for the synchronized mechanism of the invention. An embodiment of the invention which has proven to be especially advantageous for the intended movement processes of the components of the mechanism with respect to one another is one in which the position of the connection point of the coupling element to the seat support, in other words the location of force application, changes relative to the location of the connection point of the coupling element to the backrest support in dependence on the angle position of the backrest support. In other words, the position of the body lengthwise axis of the coupling element as defined by these two connection points changes due to the swivel movement of the backrest support.

In another embodiment of the invention, the coupling element moves, while the backrest support is swiveling from the non-swiveled position to the maximum backward swiveled position, from a starting position in which the body lengthwise axis of the coupling element is tilted backward (especially from bottom front to top rear) through the vertical and to a final position in which the body lengthwise axis of the coupling element is tilted forward (especially from bottom rear to top front). By passing across the vertical, a synchronized movement of seat support and backrest support is achieved, which is characterized by an especially highly variable transmission ratio.

It has proven to be especially advantageous when the position of the body lengthwise axis of the coupling element, which changes during a swiveling of the backrest support, deviates from the motion curve of the seat support, as defined by the interaction of the two guide elements, and this substantially during the entire swivel movement of the backrest support. In other words, the body lengthwise axis of the coupling element does not extend along or parallel to the motion curve of the seat support relative to the base support.

In this context, it has proven to be advantageous to the providing of the lever geometry needed for a self-adjusting mechanism when the swivel axis of the connection of the backrest support to the base support, situated transversely to the chair lengthwise direction, is situated behind the coupling element joining the backrest support and seat support, looking in the chair lengthwise direction, especially behind the swivel axis defining the location of force application.

Advantageously, a backward swiveling of the backrest support produces a lifting of the seat support in accordance with the motion curve as defined by the interaction of the two guide elements. In particular, a backward swiveling of the backrest support induces a direct lifting movement of the rear area of the seat support and at the same time a direct lifting movement of the front area of the seat support.

With the synchronized mechanism according to the invention, the occupant of the office chair lifts himself upward by applying load to the backrest. Complicated mechanical constructions to achieve the desired movement of the seat support are therefore unnecessary. The desired movement path is realized by simple design measures, namely, a linking of the backrest support to the seat support by a coupling, as well as a number of guided connections between seat support and base support.

Due to the fact that the seat support is lifted not only in its rear area, but also at the same time a lifting of the front area of the seat support occurs, there is a synchronized upward and backward entrainment of the seat in a defined ratio to the backrest. Since the occupant sitting on the seat surface performs a movement following the movement of the backrest when swiveling the backrest into a rear position, the so-called "shirt pull-out effect" is especially effectively prevented.

Other features which are considered as characteristic for the invention are set forth in the appended claims.

Although the invention is illustrated and described herein as embodied in a synchronized mechanism for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

None of the figures show the invention true to scale, but instead only schematically and with its essential components. The same reference numbers correspond to elements of the same or comparable function.

DETAILED DESCRIPTION OF THE INVENTION

Figure 1:
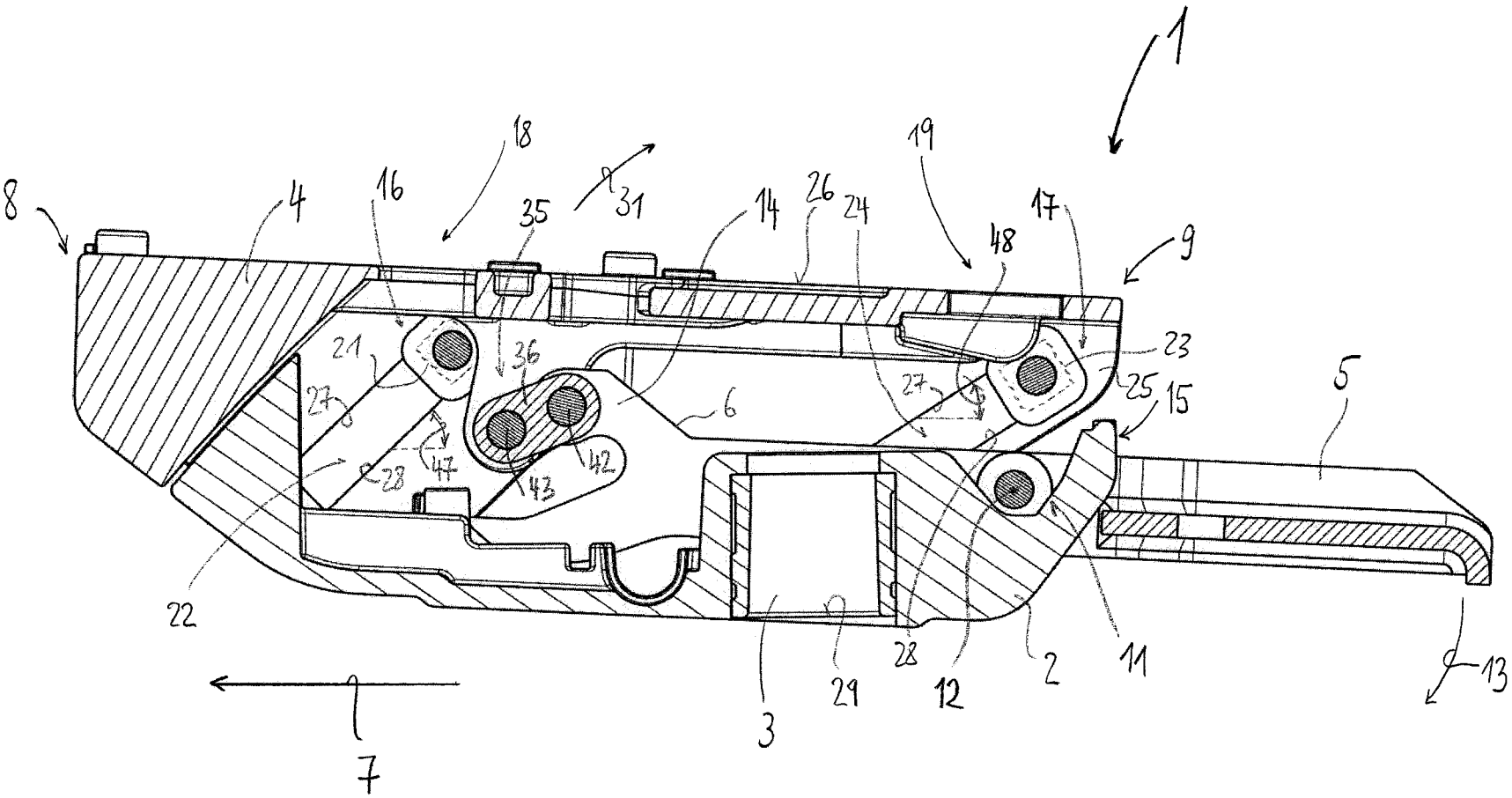
FIG. 1 is a diagrammatic, cross-sectional view of components of a synchronized mechanism along a central longitudinal plane, with backrest support not swiveled.

Referring now to the figures of the drawings in detail and first, particularly to FIG. 1 thereof, there is shown a synchronized mechanism 1 that has a base support 2, which is mountable by a conical receptacle 3 on an upper end of a non-illustrated chair column. The synchronized mechanism 1 has an essentially frame-like seat support 4 and a backrest support 5, fork-shaped in top view, whose cheeks 6 are arranged on either side of the base support 2. FIG. 1 shows the basic position in which the backrest support 5 occupies a substantially vertical position.

On the seat support 4 is mounted a seat provided with a non-illustrated cushioned seat surface. The mounting is done in a usual manner with the aid of fastening elements, not otherwise shown. The seat is firmly mounted on the seat support 4, so that a movement of the seat support 4 at the same time results in a corresponding movement of the seat.

On the backrest support 5 is arranged a not otherwise depicted backrest (not shown), which is height-adjustable in modern office chairs. The backrest may also be joined to the backrest support 5 as a single piece.

The overall synchronized mechanism 1 has a mirror symmetry construction in terms of its central longitudinal plane, insofar as the actual kinematics are concerned. Accordingly, in the following description we shall assume design elements of the actual mechanism which are always present in pairs on both sides.

"Front" or "forward" shall mean that a component is arranged in front in the chair lengthwise direction 7 or refers to a component extending in the direction of the front seat edge 8 or pointing in this direction, while "back" or "rear" shall mean that a component is arranged in back in the chair lengthwise direction 7 or refers to a component extending in the direction of the backrest or the backrest support 5 or the rear seat edge 9 or pointing in this direction. The terms "top" and "bottom" pertain to the intended state of use of the office chair or the mechanism 1.

The backrest support 5 is mounted on a swivel bearing 11 on the base support 2, such that the backrest support 5 is linked by the swivel bearing 11 directly and immediately to the base support 2. In this way, the backrest support 5 with the backrest can be swiveled backward and downward in the swivel direction 13 about the swivel axis 12 running through the swivel bearing 11 and situated transversely to the chair lengthwise direction 7. The swivel bearing 11 is formed in front of the front end 14 of the forward extending cheek 6 of the backrest support 5, or more precisely at the rear end 15 of the base support 2.

Two pairs of guide elements 16, 17 are provided, spaced apart from each other in the chair lengthwise direction 7, namely, a front guide element pair 16, looking in the chair lengthwise direction 7, by which the base support 2 is connected to a front area 18 of the seat support 4, and a rear guide element pair 17, looking in the chair lengthwise direction 7, by which the base support 2 is connected to a rear area 19 of the seat support 4. Each guide element pair 16, 17 is formed by a first guide element 21, 23 and a second guide element 22, 24 cooperating with it.

On the base support 2 there is provided a first front guide element 21 and on the seat support 4 a second front guide element 22, where the first front guide element 21 and the second front guide element 22 cooperate to form the front guide element pair 16. Furthermore, there is provided on the base support 2 a first rear guide element 23 and on the seat support 4 a second rear guide element 24, where the first rear guide element 23 and the second rear guide element 24 cooperate to form the rear guide element pair 17. The two guide element pairs 16, 17 cooperate such that a swiveling of the backrest support 5 produces a movement of the second guide elements 22, 24, moving together with the seat support 4, along the first guide elements 21, 23, which are stationary on the base support 2, and thus a movement of the seat support 4 relative to the base support 2.

The first guide elements 21, 23 each contain a sliding element and the second guide elements 22, 24 each contain a slide track along which the corresponding sliding element moves. Instead of the sliding elements, rolling elements can also be provided, which can move along roll tracks.

The slide tracks 22, 24 are formed by guide slots, contained in the seat support 4. More precisely, the guide slots 22, 24 are provided in side walls 25 of the seat support 4, extending from the seat support top side 26 sideways, essentially parallel with the outer sides of the base support 2, and vertically downward in the direction of the base support 2. Each guide slot 22, 24 has oppositely situated slide surfaces 27, so that the respective sliding element 21, 23 is guided in the slot 22, 24, resting at the same time against two bearing surfaces 27, 28, upon performing a relative movement of seat support 4 and base support 2 to each other. The slide tracks 22, 24 are designed as linear guides and run at an incline to the horizontal 29 (symbolized in the figures by the lower termination of the conical receptacle 3). The inclinations of the slide tracks or guide slots 22, 24 determine the direction of movement 31 of the seat support 4 upon a swiveling of the backrest support 5. The slide tracks 22, 24 do not necessarily run parallel to each other. In the illustrated example, they have different inclinations. The sliding elements 21, 23 can be fashioned for example in the form of sliding blocks or bolts.

The sliding elements 21, 23 resting against the guide tracks 22, 24, or more precisely situated in the guide slots, are arranged stationary on the base support 2, or more precisely joined firmly to the base support 2, but possibly able to rotate about rotation axes 32 situated transversely to the chair lengthwise direction 7. The sliding elements 21, 23 so connected to the base support 2 form together with the guide tracks 22, 24 the respective (front and rear) sliding pairing 16, 17 and thus define the location for guiding the seat support 4 on the base support 2.

Figure 4:
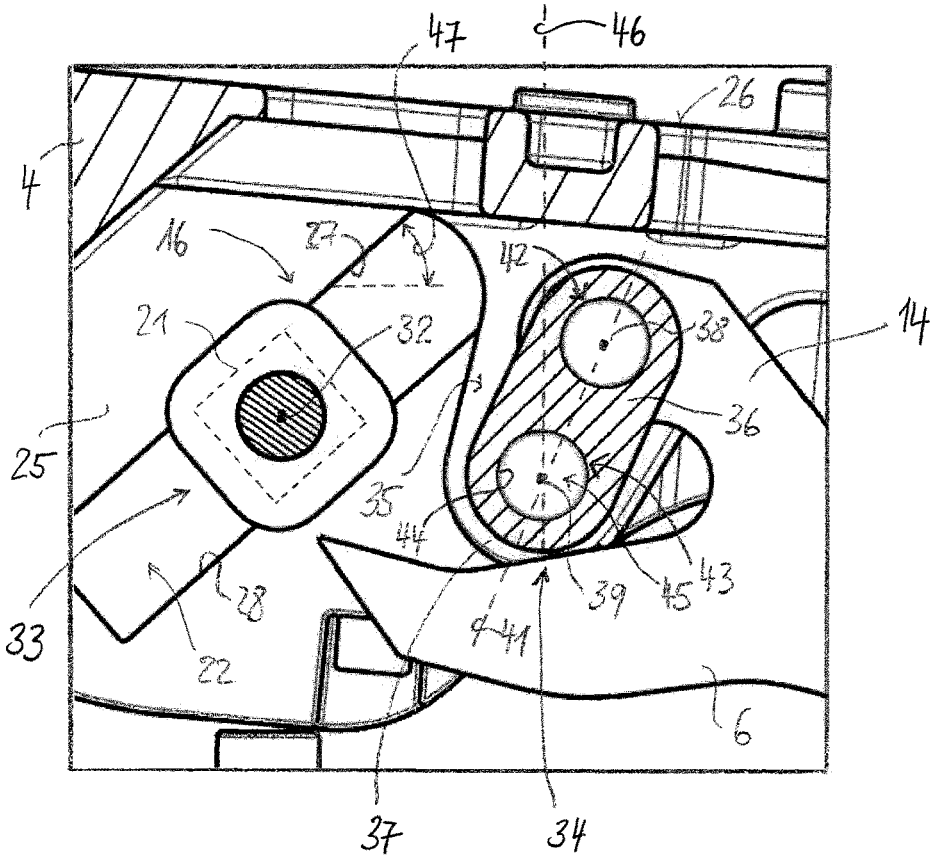
FIG. 4 is an enlarged cross-sectional view of the coupling element from FIGS. 1 to 3.

At a location 34 of force application different from this guide location 33, see FIG. 4, the lifting force is applied to the seat support 4 by the backrest support 5, more precisely, by its backward swiveling. For this purpose, the front end 14 of the backrest support 5 is not connected directly to the seat support 4, more precisely, to an arm 35 projecting downward from the top side 26 of the seat support 4 in the direction of the base support 2. Instead, a coupling element 36 is provided, articulated to the front end 14 of the backrest support 5, which on the one hand is articulated to the backrest support 5 and on the other hand articulated to the seat support 4, namely, to the free end 37 of the arm 35. The line of connection of the two swivel axes 38, 39 formed by these articulations and situated transversely to the chair lengthwise direction 7 forms the lengthwise axis 41 of the coupling element 36. In other words, the backrest support 5 is connected by the front end 14 of the cheek 6 to the seat support 4 via a coupling element 36, the coupling element 36 being articulated to both the backrest support 5 and to the seat support 4, especially forming each time a swivel joint 42, 43, wherein the force applied upon a swiveling of the backrest support 5 to the seat support 4 is applied via the first swivel joint 42 to the coupling element 36 and from there via the second swivel joint 43, connecting the coupling element 36 to the seat support 4, to the seat support 4. The coupling element 36 extends from the arm 35, provided on the right side of the seat support 4, to the arm provided on the left side of the seat support 4 (not shown, on both sides of the central longitudinal plane of the mechanism 1, thus unlike most of the other components of the mechanism described here it is not present in a pair, but only once.

The connection of the coupling element 36 to the backrest support 5 can be provided as a simple swivel joint 42 of any given kind. The connection of the coupling element 36 to the seat support 4 is preferably configured such that the coupling element 36 has an opening 44, in which an axis 45 rigidly joined to the seat support 4 is mounted, and so the coupling element 36 is rotatably mounted on the axis 45. The swivel axis 39 so configured forms the actual connection point of coupling element 36 and seat support 4 and thus the location 34 of force application, i.e., at this one location the coupling 36 is connected to the seat support 4, forming a swivel joint 43. At the same time, this is the only connection of the backrest support 5 to the seat support 4. The backrest support 5 is also connected to the base support 2 only by a single point, namely, by the main swivel axis 12 of the mechanism 1.

Upon a backward swiveling of the backrest support 5, the seat support 4 is pulled back by the backrest support 5 via the described articulated coupling, which results in a lifting movement of the seat support 4 on account of the forced guidance. The backward and upward movement path 31 of the seat support 4 results from the inclination of the guide slots 22, 24 in the seat support 4, in which the sliding elements 21, 23 of the stationary base support 2 are installed. The seat support 4 with the slots 22, 24 is moved relative to the stationary base support 2 with its sliding elements 21, 23.

The connection point 43 of the coupling element 36 to the seat support 4, which serves as the location 34 of force application to the seat support 4 upon a swiveling of the backrest support 5 and configured in particular as a swivel joint, is thus not identical to the connection point of the seat support 4 to the base support 2, serving as the location 33 for guiding the seat support 4 on the base support 2 and formed here by the guide element pairs 16, 17. In other words, the two locations 33, 34 are different, i.e., the location 34 of force application from the backrest support 5 to the seat support 4 is situated at a distance or spaced apart from the location 33 for guiding the seat support 4 on the base support 2.

The front pivot joint 43 of the coupling 36, which is the furthest away from the main swivel axis 12 of the mechanism 1, engages directly with the seat support 4 and lifts it up, while the movement path 31 traveled by the seat support 4 at a location 33 away from this location 34 of force application is realized in that guide slots 22, 24 provided on the seat support 4 move relative to sliding elements 21, 23 provided on the base support 2.

The location 34 of force application is never on one of the two guide tracks 21, 23. The location 34 of force application to the seat support 4 is always situated, i.e., in all swivel positions of the backrest support 5, behind the front guide element pair 16, looking in the chair lengthwise direction 7. Furthermore, the location 34 of force application is always located between the front guide track 21 and the rear guide track 23 or between the front guide element pair 16 and the rear guide element pair 17. The exact point 43 of connection of backrest support 5 and seat support 4 is always located, likewise looking in the chair lengthwise direction 7, in front of the conical receptacle 3. The swivel axis 12 of the connection of the backrest support 5 to the base support 2 is situated, looking in the chair lengthwise direction 7, behind the swivel axis 39 of the connection of the coupling 36 of the backrest support 5 to the seat support 4. Furthermore, both swivel axes 38, 39 of the connection of the backrest support 5 to the seat support 4 by the coupling 36 are located above the position of the swivel axis 12 of the connection of the backrest support 5 to the base support 2.

The location 34 of force application changes relative to the location of the connection point 42 of the coupling element 36 to the backrest support 5 in dependence on the angle position of the backrest support 5. In other words, the position of the body lengthwise axis 41 of the coupling element 36, as defined by the two connection points 42, 43, is changed by the swivel movement of the backrest support 5.

By a backward and downward swiveling of the backrest support 5, the seat support 4 is entrained in the swivel direction 13 and lifted by virtue of the guide means 21, 22, 23, 24. The coupling element 36 moves, while the backrest support 5 is swiveling from the unswiveled position to the maximum backward swiveled position, from a starting position in which the body lengthwise axis 41 of the coupling element 36 is tilted backward (namely, in particular, from bottom front to top rear) through the vertical 46 running through the swivel axis 39 and to a final position in which the body lengthwise axis 41 of the coupling element 36 is tilted forward (namely, from bottom rear to top front).

The changing position of the body lengthwise axis 41 of the coupling element 36 during a swiveling of the backrest support 5 deviates from the motion curve of the seat support 4 as defined by the guide element pairs 16, 17, and this substantially during the entire swivel movement of the backrest support 5. In other words, the body lengthwise axis 41 of the coupling element 36 does not run along or parallel to the motion curve of the seat support 4 relative to the base support 2.

A backward swiveling of the backrest support 5 produces a lifting of the seat support 4 corresponding to the motion curve as defined by the interaction of the guide element pairs 16, 17. A backward swiveling of the backrest support 5 induces an immediate lifting movement of the rear area 19 of the seat support 4 and at the same time an immediate lifting movement of the front area 18 of the seat support 4.

Due to the arrangement of the guide tracks 22, 24, not just the rear area 19 of the seat support 4 performs a lifting movement when the backrest is placed under load and the backrest support 5 performs a backward and downward swivel movement in the swivel direction 13. Furthermore, the front area 18 of the seat support 4 will also be lifted linearly in a synchronized manner. In other words, a simultaneous lifting movement of the front and rear end of the seat surface occurs. The seat in its entirety is lifted. At the same time, the lifting movement of the front area 18 of the seat support 4 is greater than the lifting movement of the rear area 19 of the seat support. Thus, the seat is lifted more in front than in back. In other words, the seat support 4 also performs a backward tilting movement upon swiveling of the backrest support 5.

During a swiveling of the backrest support 5 from a starting position to a swivel position (and back), the seat support 4 with the backrest support 5 coupled to the seat support 4 moves backward in the swivel direction 13. At the same time, the seat support 4 is lifted. The movement of the seat support 4 in the seat lengthwise direction 7 therefore has a tilting or swivel movement of the seat support 4 (backward) superimposed on it.

The position of the lengthwise axis 41 of the coupling element 36 during the swiveling of the backrest support 5 on the one hand and the inclination of the first and second guide tracks 22, 24 on the other hand or the ratio of these positions and inclinations relative to each other produces a definite motion characteristic of the mechanism 1 or the office chair.

The front guide track 22 in the starting position of the backrest support 5 not swiveled backward, in the example illustrated here, runs at an angle of around 45 degrees to the horizontal 29 from front bottom to rear top, looking in the chair lengthwise direction 7, i.e., rising toward the rear. Tilt angles 47 of the front guide track 22 to the horizontal 29 between 40 and 50 degrees have proven to be especially advantageous. Advantageously, the rear guide track 24 makes an angle with the horizontal 29 which is smaller by around 20 to 25 percent than the front guide track 22. The rear guide track 24 runs at an angle of around 35 degrees to the horizontal 29, thus rising toward the rear like the front guide track 22. Tilt angles 48 of the rear guide track 24 between 30 and 40 degrees have proven to be especially advantageous.

In the base position of the backrest support 5 not swiveled, as represented in FIG. 1, the coupling element 36 in the example illustrated here is situated like the first and second guide track 22, 24 with an orientation of around 25 degrees to the horizontal 29.

Figure 2:
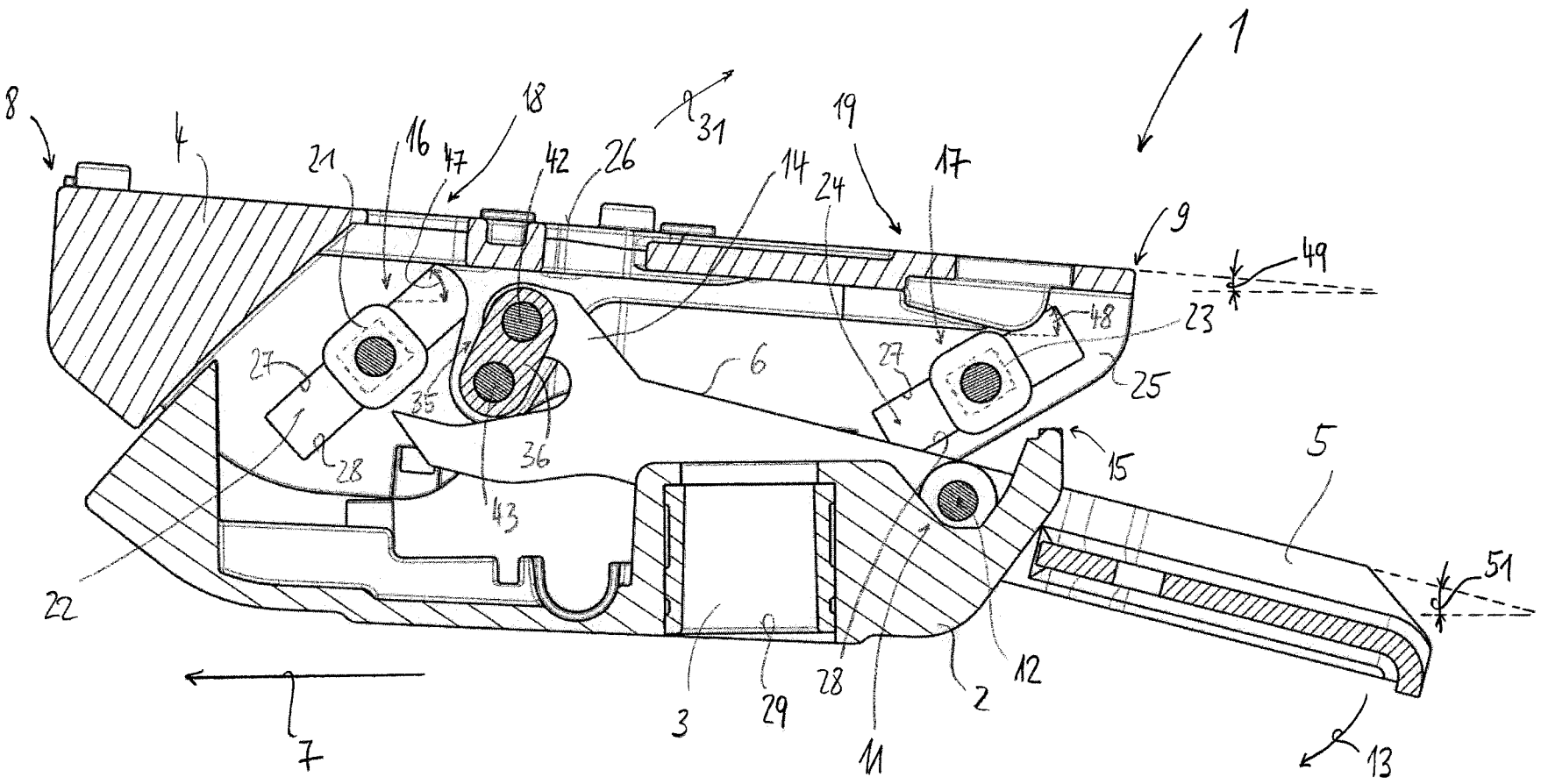
FIG. 2 is a cross-sectional view of the components of the synchronized mechanism of FIG. 1, with backrest support partly swiveled back.

FIG. 2 represents the partly swiveled condition, in which the body lengthwise axis 41 of the coupling element 36 is situated in an exactly tangential position to the circular path resulting by a backward and downward swiveling of the backrest support 5 about the main swivel axis 12. In this one position, the motion vectors of the swivel axes 38, 39 are identically directed, so that the force applied from the backrest support 5 via the swivel axis 38 to the coupling element 36 is passed on without losses by the swivel axis 39 from the coupling element 36 to the seat support 4. In this position, the seat support 4 experiences the maximum force transmission and thus velocity. In all other positions, this is not the case, and the transfer of force or velocity to the seat support 4, in other words the direct application of motion to the seat support 4, occurs only to a lesser extent. This means that, depending on the position of the coupling element 36, always only a particular force component, i.e., only a particular fraction of the force transmitted by the backrest support 5, will be passed on to the seat support 4. The magnitude of this force fraction is dictated or defined by the position angle 47, 48 of the guide tracks 22, 24. The position of the force application point 43 relative to the point of connection 42 of the coupling element 36 with the backrest support 5 thus changes in dependence on the swivel angle of the backrest support 5.

When the seat occupant leans against the backrest of the office chair, the backrest support 5 pulls the seat support 4 upward, the inclination of the coupling element 36 in dependence on the swivel position of the backrest support 5 being more or less different from the inclinations of the guide tracks 22, 24. This produces the special motion characteristic of the synchronized mechanism 1, because always only a particular fraction of the lifting force of the backrest support 5 is or can be passed on to the forcefully guided seat support 4.

Figure 3:
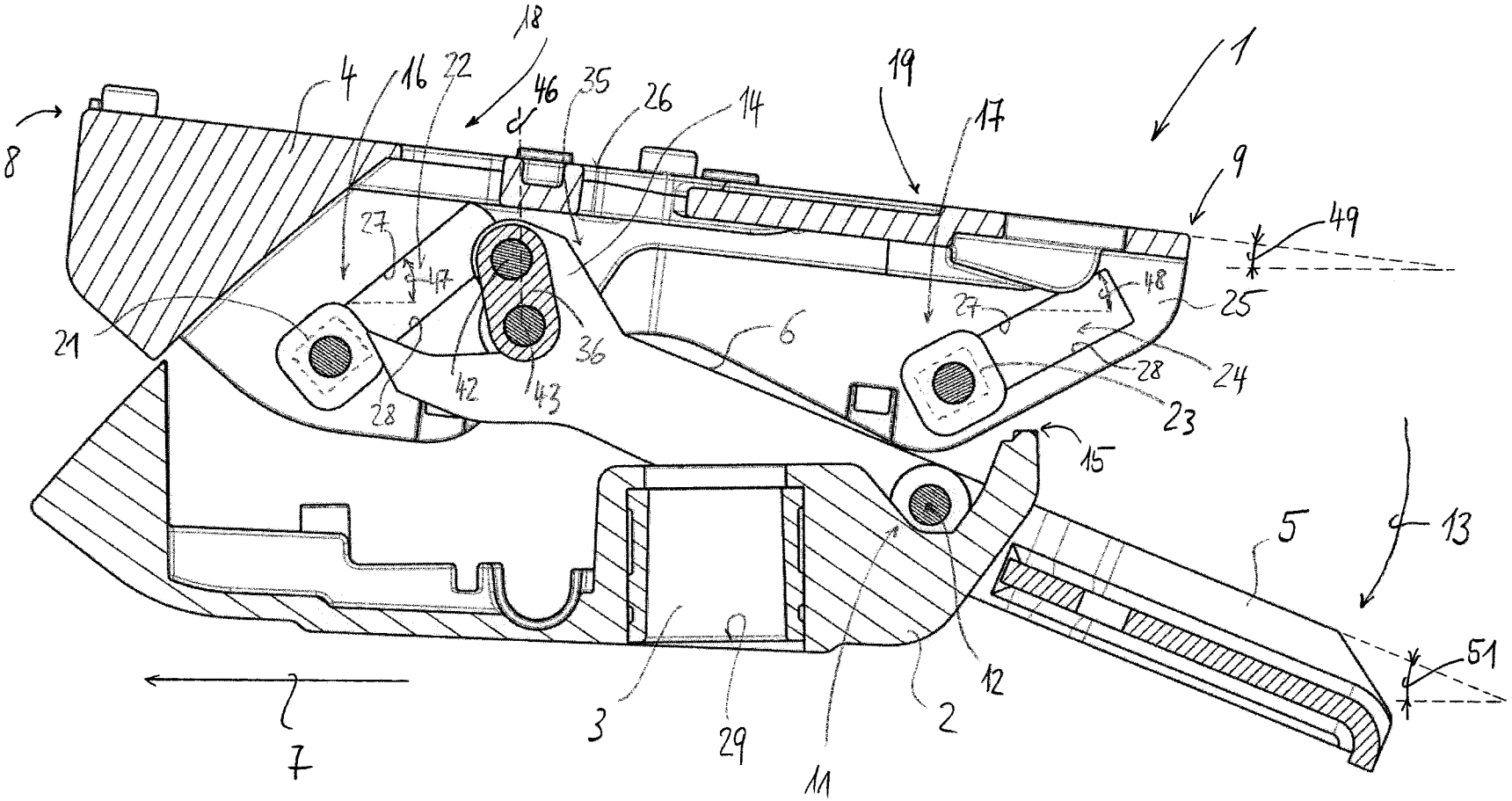
FIG. 3 is cross-sectional view of the components of the synchronized mechanism of FIG. 1, with backrest support fully swiveled back.

In the end position represented in FIG. 3, the maximum backward swiveled position of the backrest support 5, the lengthwise axis 41 of the coupling element 36 makes an angle with the horizontal 29 of around 100 degrees. The coupling element 36 is thus swiveled or tilted forward past the vertical 46, or the vertical position of the coupling element 36. The point of connection 42 between coupling element 36 and backrest support 5 is thus situated in front of the force application location 34, or point of connection 43 of the coupling element 36 to the seat support 4, looking in the chair lengthwise direction 7.

Figure 5:
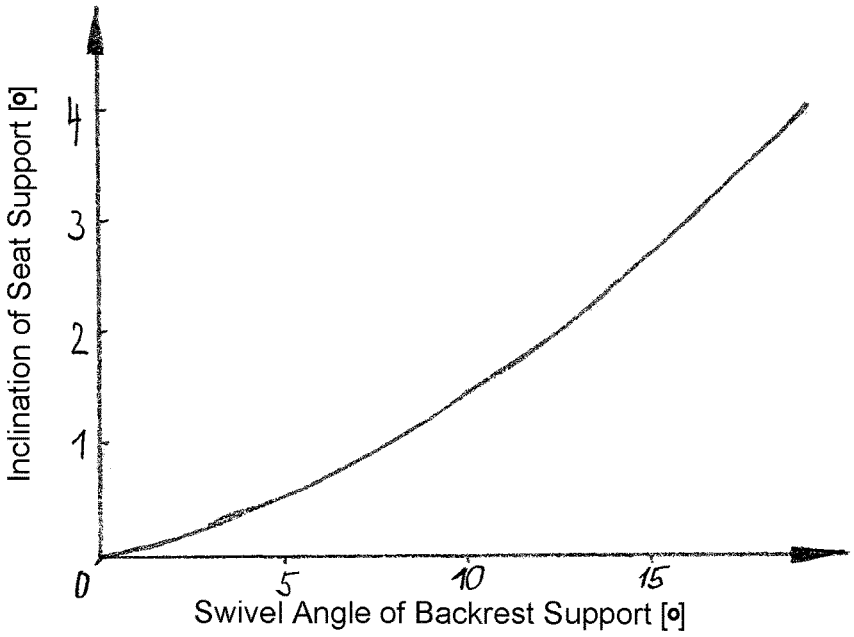
FIG. 5 is a graph showing a quantitative tilting of the seat support as a function of the swivel angle of the backrest support.

If one plots the seat angle, i.e., the inclination 49 of the seat support 4, against the swivel angle 51 of the backrest support 5, a nonlinear relation will be found, see FIG. 5, on account of the specifically designed motion characteristic of the synchronized mechanism 1 according to the invention. The velocity of the seat support 4 increases, while the velocity of the backrest support 5 stays the same. More precisely, for the same rate of change of the angle of deflection 51 of the backrest support 5, as the swivel angle 51 of the backrest support 5 increases there results a changing, i.e., an increasing rate of change of the tilt angle 49 of the seat support 4. This progressivity, which is experienced by a chair occupant as an "acceleration effect", distinguishes the motion characteristic of the mechanism 1.

A number of suitable spring elements, secured to suitable linkage points, may be provided between base support 2 and seat support 4, serving to retract the seat support 4 from the backward swiveled position to the starting position or to assist in such a retraction.

All features represented in the description, the following claims, and the drawing may be significant to the invention either alone or in any given combination.

The following is a summary list of reference numerals and the corresponding structure used in the above description of the invention:

1 Synchronized mechanism
2 Base support
3 Conical receptacle
4 Seat support
5 Backrest support
6 Cheek
7 Chair lengthwise direction
8 Front seat edge
9 Rear seat edge
10 (free)
11 Swivel bearing
12 Swivel axis
13 Swivel direction
14 Front end of cheek
15 Rear end of base support
16 Front guide element pair
17 Rear guide element pair
18 Front area of seat support

19 Rear area of seat support
20 (free)
21 First front guide element, sliding element
22 Second front guide element, slide track
23 First rear guide element, sliding element
24 Second rear guide element, slide track
25 Side wall of seat support
26 Seat support top side
27 First slide surface
28 Second slide surface
29 Horizontal
30 (free)
31 Direction of movement
32 Rotation axis of sliding element
33 Guide location
34 Force application location
35 Arm of seat support
36 Coupling element
37 Free end of arm
38 Swivel axis of first swivel joint
39 Swivel axis of second swivel joint
40 (free)
41 Lengthwise axis of coupling element
42 First swivel joint
43 Second swivel joint
44 Opening
45 Axis
46 Vertical
47 Tilt angle of front track
48 Tilt angle of rear track
49 Tilting of seat support
50 (free)
51 Tilting of backrest support

The invention claimed is:

1. A synchronized mechanism for a correlated seat/backrest movement of an office chair, the synchronized mechanism comprising:

a base support mountable on a chair column;

a seat support disposed on said base support and movable relative to said base support;

a coupling element;

a backrest support connected to said seat support, wherein a swiveling of said backrest support produces a movement of said seat support relative to said base support, wherein said backrest support able to swivel about a transverse axis is articulated directly to said base support, wherein said backrest support is connected to said seat support via said coupling element;

said coupling element is articulated both to said backrest support and to said seat support, wherein a force applied to said seat support upon swiveling said backrest support is applied to said seat support solely via said coupling element;

first guide elements disposed on said base support;

second guide elements disposed on said seat support, wherein one of said first guide elements and one of said second guide elements cooperate to form a guide element pair such that the swiveling of said backrest support produces a movement of said one second guide element along said one first guide element and thus a movement of said seat support relative to said base support;

said first and second guide elements forming two guide element pairs disposed, spaced apart from each other in a chair lengthwise direction, and including a front guide element pair being in an anterior position looking in the chair lengthwise direction and a rear guide element being in a posterior position pair looking in the chair lengthwise direction; and a connection point of said coupling element to said seat support serving as a location of force application to said seat support upon the swiveling of said backrest support is not identical to a connection point of said seat support to said base support serving as a location for guiding said seat support on said base support.

2. The synchronized mechanism according to claim 1, wherein either said first guide elements contain a sliding or rolling element and said second guide elements contain a slide or roll track along which the sliding or rolling element moves, or said second guide elements contain a sliding or rolling element and said first guide elements contain a slide or roll track along which the sliding or rolling element moves.

3. The synchronized mechanism according to claim 1, wherein a location of force application, looking in the chair lengthwise direction, is always situated behind said front guide element pair.

4. The synchronized mechanism according to claim 1, wherein a position of said connection point of said coupling element to said seat support changes relative to a location of a connection point of said coupling element to said backrest support in dependence on an angle position of said backrest support.

5. The synchronized mechanism according to claim 1, wherein said coupling element upon the swiveling of said backrest support from a non-swiveled position to a maximum backward swiveled position moves from a starting position in which a body lengthwise axis of said coupling element is tilted backward through a vertical and to a final position in which the body lengthwise axis of said coupling element is tilted forward.

6. The synchronized mechanism according to claim 1, wherein the transverse axis, looking in the chair lengthwise direction, is positioned behind said coupling element.

7. The synchronized mechanism according to claim 1, wherein a backward swiveling of said backrest support lifts said seat support in accordance with a movement path of said seat support.

8. The synchronized mechanism according to claim 1, wherein a location of force application, looking in the chair lengthwise direction, is always situated between said front guide element pair and said rear guide element pair.

* * * * *